US010503113B2

(12) United States Patent
Kidaka

(10) Patent No.: US 10,503,113 B2
(45) Date of Patent: Dec. 10, 2019

(54) IMAGE FORMING APPARATUS HAVING RUBBING MEMBER IN CONTACT WITH IMAGE BEARING MEMBER

(71) Applicant: CANON KABUSHIKI KAISHA, Tokyo (JP)

(72) Inventor: Hiroyuki Kidaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/253,685

(22) Filed: Jan. 22, 2019

(65) Prior Publication Data

US 2019/0155203 A1 May 23, 2019

Related U.S. Application Data

(63) Continuation of application No. PCT/JP2017/023019, filed on Jun. 22, 2017.

(30) Foreign Application Priority Data

Jul. 29, 2016 (JP) ..... 2016-150619

(51) Int. Cl.
*G03G 21/00* (2006.01)
*G03G 15/00* (2006.01)
(Continued)

(52) U.S. Cl.
CPC ..... *G03G 15/75* (2013.01); *G03G 5/047* (2013.01); *G03G 5/147* (2013.01);
(Continued)

(58) Field of Classification Search
CPC ..... G03G 15/75; G03G 15/751; G03G 5/047; G03G 5/14717; G03G 21/0058;
(Continued)

(56) References Cited

U.S. PATENT DOCUMENTS 9,128,404 B2 9/2015 Higaki
2003/0118383 A1* 6/2003 Endo ..... G03G 9/0819 399/350

(Continued)

FOREIGN PATENT DOCUMENTS

JP S60-107076 A 6/1985
JP S63-068871 A 3/1988

(Continued)

OTHER PUBLICATIONS

Machine translation of JP 2015-152640 A (publication date of Aug. 24, 2015) printed on Apr. 17, 2019.*

(Continued)

*Primary Examiner* — Sophia S Chen
(74) *Attorney, Agent, or Firm* — Venable LLP

(57) ABSTRACT

An image forming apparatus includes an image bearing member, a charging member, an exposing device, a developing device, a transfer member, and a rubbing member. The image bearing member includes a plurality of recess portions on a surface thereof. The rubbing member is configured to come into contact with the image bearing member to form a rubbing nip portion between the rubbing member and the image bearing member. The recess portions each have an opening portion whose maximum length in the rotational direction is 20 μm to 120 μm. When a linear speed of the image bearing member in the rubbing nip portion is S1 and a linear speed of the rubbing member in the same direction as the linear speed of the image bearing member in the rubbing nip portion is S2, a relationship of a linear speed ratio of S2/S1<1.0 is satisfied.

7 Claims, 7 Drawing Sheets

(51) Int. Cl.
*G03G 5/047* (2006.01)
*G03G 5/147* (2006.01)

(52) U.S. Cl.
CPC ..... *G03G 5/14717* (2013.01); *G03G 15/5008* (2013.01); *G03G 21/0094* (2013.01); *G03G 21/0076* (2013.01)

(58) Field of Classification Search
CPC ..... G03G 5/147; G03G 15/5008; G03G 21/0076; G03G 21/0094
See application file for complete search history.

(56) References Cited

U.S. PATENT DOCUMENTS

2007/0292178 A1* 12/2007 Iwasaki ..... G03G 21/0058 399/357
2009/0092927 A1 4/2009 Choi et al.
2011/0158722 A1* 6/2011 Kobayashi ..... G03G 21/0058 399/357
2014/0037326 A1* 2/2014 Hashimoto ..... G03G 21/0058 399/103
2014/0093281 A1* 4/2014 Takahashi ..... G03G 15/75 399/159
2014/0169826 A1* 6/2014 Higaki ..... G03G 15/0258 399/100
2016/0378053 A1* 12/2016 Kamimori ..... G03G 21/0035 399/71
2018/0312653 A1* 11/2018 Katano ..... B29C 44/00

FOREIGN PATENT DOCUMENTS

JP 2005-134776 A 5/2005
JP 2007-057831 A 3/2007
JP 2007-079008 A 3/2007
JP 2014-119624 A 6/2014
JP 2015-152640 A 8/2015
JP 2015-161786 A 9/2015

OTHER PUBLICATIONS

International Search Report dated Jul. 25, 2017, in International Application No. PCT/JP2017/023019.

* cited by examiner

IMAGE FORMING APPARATUS HAVING RUBBING MEMBER IN CONTACT WITH IMAGE BEARING MEMBER

CROSS-REFERENCE TO RELATED APPLICATIONS

This application is a Continuation of International Patent Application No. PCT/JP2017/023019, filed Jun. 22, 2017, which claims the benefit of Japanese Patent Application No. 2016-150619, filed Jul. 29, 2016, both of which are hereby incorporated by reference herein in their entirety.

BACKGROUND OF THE INVENTION

Field of the Invention

The present invention relates to an image forming apparatus such as a copier, a laser beam printer, or a process cartridge employing an electrophotographic system or an electrostatic recording system.

Background Art

Conventionally, an image forming apparatus of an electrophotographic system is widely used as a copier, a printer, a plotter, a facsimile machine, or a multifunctional printer having functions of a plurality of these. As an image forming apparatus of this kind, an image forming apparatus that develops an electrostatic image formed on a photosensitive member by using two-component developer including non-magnetic toner and magnetic carrier is widely used. As the photosensitive member, an organic electrophotographic photosensitive member, in which an organic photosensitive layer for which an organic material is used as a photoconductive substance such as a charge-generating substance or a charge-transporting substance is provided on a support body is widely used from the viewpoint of low cost and high productivity. Examples of the organic electrophotographic photosensitive member include a photosensitive drum and an image bearing member. As this organic electrophotographic photosensitive member, a photosensitive member including a laminated photosensitive layer formed by laminating a charge generating layer containing a charge-generating substance of a photosensitive dye or a photosensitive pigment and a charge transport layer containing a charge-transporting substance of a photosensitive polymer or a photosensitive low-molecular-weight compound is mainly used. Such a photosensitive member including a laminated photosensitive layer is advantageous in terms of sensitivity and variety of material design.

Since electric external force or mechanical external force is directly applied to the surface of the photosensitive member during charging, exposure, developing, transfer, and cleaning, the photosensitive member is required to have durability against these external forces. Specifically, the photosensitive member is required to have durability against generation of scratches or wear on the surface by these external forces, that is, scratch resistance and wear resistance. As a photosensitive member whose scratch resistance and wear resistance of the surface thereof are improved, for example, a photosensitive member including, as a surface layer, a cured layer formed by using a curable resin as a binder resin is known. In addition, a photosensitive member including, as a surface layer, a charge-transporting cured layer formed by curing polymerization of a monomer having a carbon-carbon double bond and a charge-transporting property is also known. Further, a photosensitive member including, as a surface layer, a charge-transporting cured layer formed by causing curing polymerization of a hole-transporting compound having a chain-polymerizable functional group in the molecule by energy of an electron beam is also known. As described above, as a technique of improving the scratch resistance and wear resistance of a peripheral surface of the photosensitive member, a technique of using a cured layer as a surface layer of a photosensitive member and thus increasing the mechanical strength of the surface layer has been established in recent years.

However, when image formation is performed by using a photosensitive member having a high hardness, blur of an electrostatic latent image called image deletion is likely to occur particularly in a high-humidity environment. The cause of this image deletion is considered as follows. Electric discharge products such as ozone and NOx are generated mainly in a charging portion, and attach to the surface of the photosensitive member. The surface of the photosensitive member has a low surface friction coefficient, is hard, and thus is not easy to wear, and therefore the electric discharge products attached to the surface are difficult to remove. It is considered that such electric discharge products that have attached to the surface and are difficult to remove absorb moisture in the high-humidity environment, thus degrade charge retaining capability of the surface of the photosensitive member, and cause the blur of electrostatic latent image. Therefore, particularly in the case where the hardness of the photosensitive member is high, the electric discharge products attached thereto become more difficult to remove, and the image deletion becomes more likely to occur.

A typical measure to suppress the occurrence of image deletion is drying the surface of the photosensitive member by installing a heater inside the photosensitive member or in the vicinity of the photosensitive member and raising the surface temperature of the photosensitive member. However, in the case where image formation is performed at a time when the effect of this means cannot be sufficiently obtained, for example, immediately after turning the power on, image deletion sometimes occurs. Particularly, in recent years, some apparatuses do not incorporate a heater from the viewpoint of saving energy or the like.

Therefore, an image forming apparatus, in which toner containing an abrasive such as titanium oxide is used, an abrasive portion such as an abrasive roller is disposed between a cleaning unit and a transfer member, and the surface of the photosensitive drum is polished by rubbing, has been developed to prevent image deletion. This is disclosed in, for example, Japanese Patent Laid-Open No. 2005-134776. In this image forming apparatus, the electric discharge products such as ozone and NOx present on a photosensitive drum can be removed by polishing a smooth surface of the photosensitive drum, and thus the image deletion can be prevented. In this image forming apparatus, an abrasive roller is preferably rotated in a direction following the rotational direction of the photosensitive drum at a linear speed ratio of about 1.1 to 1.2 with respect to the photosensitive drum. As a result of this, the electric discharge products can be efficiently removed while suppressing occurrence of insufficiency of polishing force and occurrence of jitter. In contrast, when the abrasive roller is rotated in the direction following the rotational direction of the photosensitive drum at a linear speed ratio smaller than 1.1 with respect to the photosensitive drum or in a direction opposite to the rotational direction of the photosensitive drum, there is a possibility that the surface layer of the roller is abraded due to increase in the torque.

In addition, an image forming apparatus in which a plurality of independent recess portions are defined on the surface of a photosensitive drum in order to suppress the occurrence of abnormal electric discharge between the photosensitive drum and a charging portion to maintain uniformity of an image has been developed. This is disclosed in Japanese Patent Laid-Open No. 2015-152640.

However, in the case where the plurality of independent recess portions are defined on the surface of the photosensitive drum to suppress the occurrence of abnormal electric discharge between the photosensitive drum and the charging portion in the image forming apparatus of Japanese Patent Laid-Open No. 2005-134776 described above, there is a possibility that the following problem occurs. That is, in the case where an abrasive roller is rotated in the direction following the rotational direction of the photosensitive drum having recess portions at a linear speed faster than the photosensitive drum, capability of removing electric discharge products is sometimes degraded. Therefore, in the case where the abrasive roller is rotated further faster in order to secure the polishing performance, image defects caused by scattering of toner and abrasion of the surface layer of the roller caused by increase in torque sometimes simultaneously occur.

SUMMARY OF THE INVENTION

According to one aspect of the present invention, an image forming apparatus includes an image bearing member comprising a plurality of recess portions on a surface thereof and configured to rotate, a charging member configured to charge the image bearing member, an exposing device configured to expose the charged image bearing member to form an electrostatic image, a developing device configured to develop the electrostatic image formed on the image bearing member by toner, a transfer member configured to form a transfer portion between the transfer member and the image bearing member and transfer a toner image formed on the image bearing member onto a transfer material at the transfer portion, and a rubbing member disposed downstream of the transfer member and upstream of the charging member in a rotational direction of the image bearing member, formed from a rotary member including a surface layer formed from an elastic body, and configured to come into contact with the image bearing member to form a rubbing nip portion between the rubbing member and the image bearing member. The recess portions each have an opening portion whose maximum length in the rotational direction is 20 μm to 120 μm. In a case where a linear speed of the image bearing member in the rubbing nip portion is S1 and a linear speed of the rubbing member in the same direction as the linear speed of the image bearing member in the rubbing nip portion is S2, a relationship of a linear speed ratio of $S2/S1<1.0$ is satisfied.

Further features of the present invention will become apparent from the following description of exemplary embodiments with reference to the attached drawings.

DESCRIPTION OF THE EMBODIMENTS

An exemplary embodiment of the present invention will be described below in detail with reference to FIGS. 1 to 3.

In the present exemplary embodiment, a full-color printer of a tandem type is described as an example of an image forming apparatus 1. However, the present invention is not limited to the image forming apparatus 1 of a tandem type, and may be an image forming apparatus of another system. In addition, the present invention is not limited to a full-color printer, and may be a monochromatic printer. Further, the present invention can be implemented in various applications such as a printer, various printing machines, a copier, a facsimile machine, and a multifunctional printer.

Figure 1:
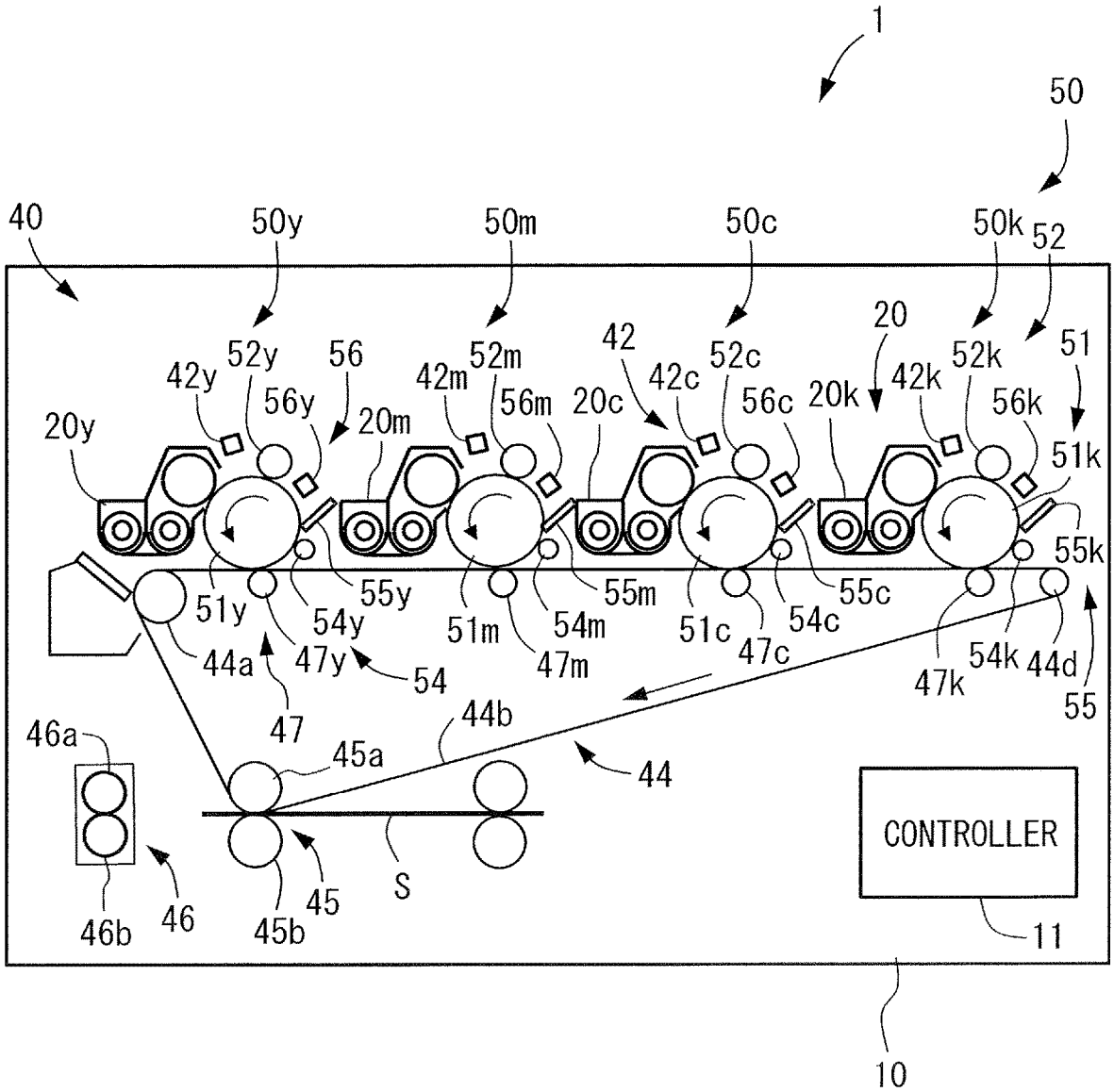
FIG. 1 is a section view of an image forming apparatus according to an exemplary embodiment illustrating a schematic configuration thereof.
Figure 2:
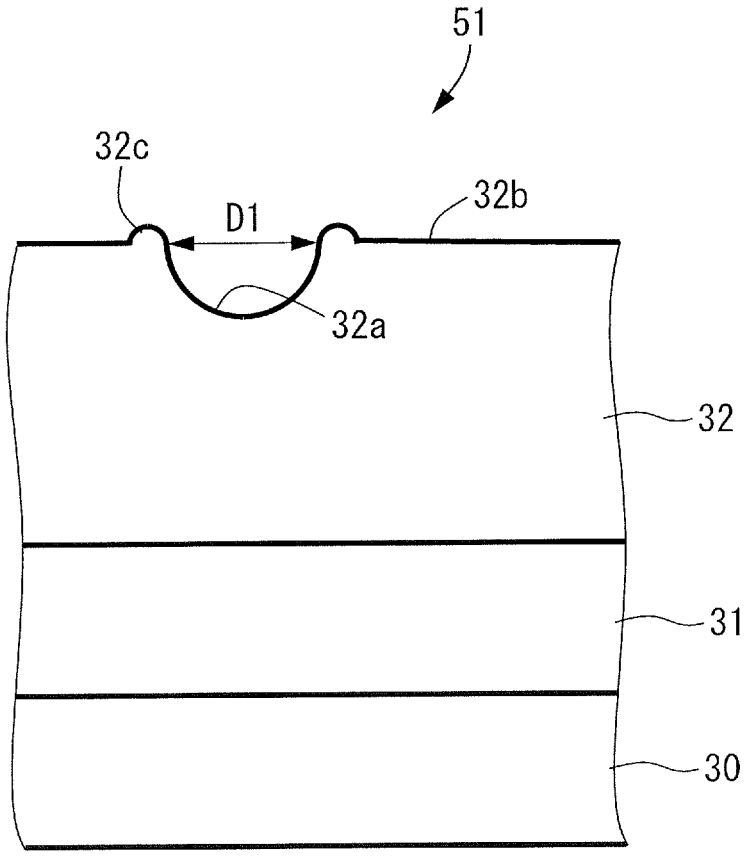
FIG. 2 is an enlarged section view of a surface layer of a photosensitive drum of the image forming apparatus according to the exemplary embodiment.

As illustrated in FIG. 1, the image forming apparatus 1 includes an apparatus body 10, an unillustrated sheet feeding portion, an image forming portion 40, an unillustrated sheet discharge portion, and a controller 11. The image forming apparatus 1 is capable of forming a four-color image on a recording material in accordance with an image signal from an unillustrated image reading apparatus, a host device such as a personal computer, or an external device such as a digital camera or a smartphone. To be noted, a sheet S serving as a recording material is configured to carry a toner image formed thereon, and specific examples thereof include a plain paper sheet, a synthetic resin sheet that is a substitute for a plain paper sheet, a cardboard, and a sheet for an overhead projector.

The image forming portion 40 is capable of forming an image on a sheet S fed from the sheet feeding portion on the basis of image information. The image forming portion 40 includes image forming units 50*y*, 50*m*, 50*c*, and 50*k*, unillustrated toner bottles, exposing units 42*y*, 42*m*, 42*c*, and 42*k* serving as exposing devices, an intermediate transfer unit 44, a secondary transfer portion 45, and a fixing portion 46. To be noted, the image forming apparatus 1 of the present exemplary embodiment is capable of full-color printing, and the image forming units 50*y*, 50*m*, 50*c*, and 50*k* have similar configurations and are separately provided for respective four colors of yellow, magenta, cyan, and black. Therefore, in FIG. 1, each component of the four colors is denoted by a combination of the same reference sign and a color identifier added at the end thereof. In this case, y corresponds to yellow, m corresponds to magenta, c corresponds to cyan, and k corresponds to black. However, in FIG. 2 and other figures and in the description, each component is sometimes denoted only by the reference sign without the color identifier.

An image forming unit 50 includes a photosensitive drum 51 serving as an image bearing member on which a toner image is to be formed, a charging roller 52 serving as a charging member, a developing unit 20 serving as a developing device, an abrasive roller 54, i.e. a rubbing roller, serving as a rubbing member, a cleaning blade 55, and an electricity removing device 56. The image forming unit 50 is formed as an integral unit with a process cartridge, and is configured to be attachable to and detachable from the apparatus body 10.

The photosensitive drum 51 is rotatable, and carries an electrostatic image to be used for image formation. The photosensitive drum 51 is a negatively-chargeable organic photosensitive member (OPC) having a length of 340 mm and an outer diameter of 30 mm, and is rotationally driven in an arrow direction at a process speed, which is a peripheral speed, of, for example, 300 mm/sec. As illustrated in FIG. 2, the photosensitive drum 51 includes an aluminum cylinder as a base body 30, and a surface layer formed on the surface thereof by laminating a charge generation layer 31 formed from an organic material and a charge transport layer 32 having a thickness of about 20 μm in this order from the bottom to the top. The surface layer of the photosensitive drum 51 is a cured layer formed by using a curable resin as a binder resin.

The surface layer of the photosensitive drum 51 includes a plurality of independent specific recess portions 32*a* and a flat portion 32*b*, and the details thereof will be described later. That is, the photosensitive drum 51 rotates with the specific recess portions 32*a* on the surface thereof. To be noted, although a cured layer formed from a curable resin is used for surface curing treatment of the photosensitive drum 51 in the present exemplary embodiment, the configuration is not limited to this. For example, a charge-transporting cured layer formed by causing curing polymerization of a monomer having a carbon-carbon double bond and a charge-transporting monomer having a carbon-carbon double bond by energy of heat or light may be used. Alternatively, a charge-transporting cured layer formed by causing curing polymerization of a hole-transporting compound having a chain-polymerizable functional group in the molecule by energy of an electron beam may be used.

Figure 3:
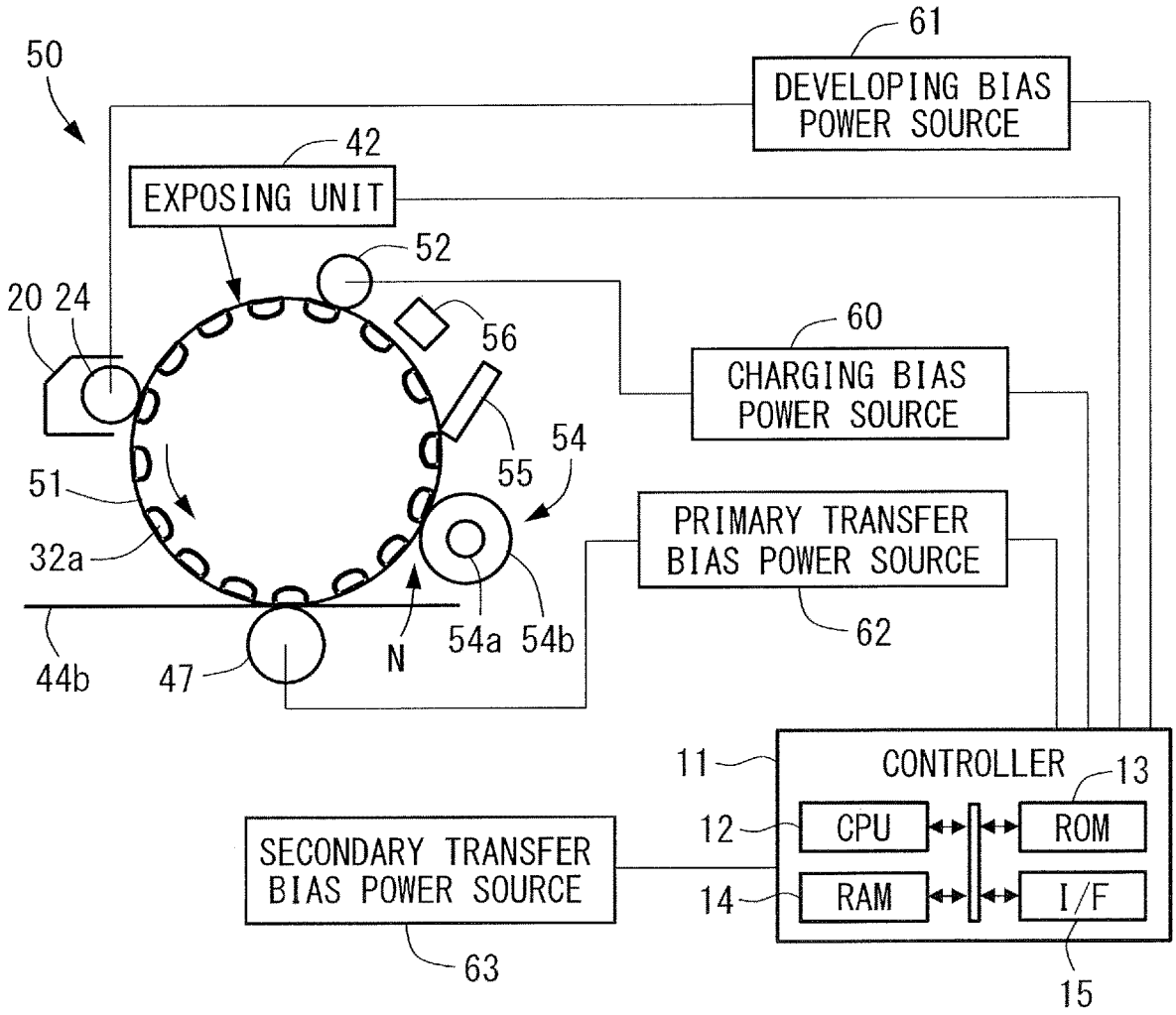
FIG. 3 is a section view of the photosensitive drum and mechanisms therearound of the image forming apparatus according to the exemplary embodiment illustrating a schematic configuration thereof.

As illustrated in FIG. 3, a rubber roller that comes into contact with the surface of the photosensitive drum 51 and rotates in accordance therewith is used as the charging roller 52, and the charging roller 52 uniformly charges the surface of the photosensitive drum 51. In the present exemplary embodiment, the charging roller 52 has a length of 330 mm in the axial direction and a diameter of 14 mm, and is formed by providing a conductive rubber layer on the outside of a core metal of stainless steel. The charging roller 52 is rotatably held by bearing members at both end portions of the core metal thereof, and is urged toward the photosensitive drum 51 by a pressing spring to be in pressure contact with the surface of the photosensitive drum 51 at a predetermined pressing force. As a result of this, the charging roller 52 rotates in accordance with the rotation of the photosensitive drum 51. In this case, the peripheral speed of the charging roller 52 is 300 mm/sec. The charging roller 52 charges the surface of the photosensitive drum 51 at a charging nip portion between the charging roller 52 and the photosensitive drum 51 by using an electric discharge phenomenon occurring in a minute gap therebetween.

The core metal of the charging roller 52 is connected to a charging bias power source 60, and a charging bias voltage of a predetermined condition is applied thereto from the charging bias power source 60. In the present exemplary embodiment, the charging bias power source 60 is constituted by, for example, a direct current (DC) power source and an alternate current (AC) power source. For example, in the case where a DC bias to be applied is set to −500 V and an AC bias is set to a peak-to-peak bias that is at least double the discharge inception voltage in the environment, an image forming part of the rotating photosensitive drum 51 is uniformly charged to about −500V immediately after passing through the charging nip portion. To be noted, the DC bias applied during image formation is not limited to this voltage, and is appropriately set to a potential suitable for good image formation in accordance with the environment and operation history of the photosensitive drum 51 and the charging roller 52.

The exposing unit 42 is a laser scanner including a semiconductor laser, and emits laser light to form an electrostatic image by exposing the charged photosensitive drum 51 in accordance with color-divided image information output from the controller 11. That is, the exposing unit 42 outputs laser light modulated in correspondence with an image signal transmitted to the controller 11 from a host processing apparatus such as an image reading apparatus, and thus performs, at an exposing position, laser scanning exposure on the surface of the rotating photosensitive drum 51 that has been uniformly charged. As a result of this laser scanning exposure, the potential of a part irradiated with the laser light on the surface of the photosensitive drum 51 decreases, and an electrostatic latent image corresponding to the image information is sequentially formed on the surface of the rotating photosensitive drum 51.

The developing unit, serving as the developing device, 20 includes a developer container that accommodates developer, and a developing sleeve 24. In the present exemplary embodiment, the length of the developing sleeve 24 in the axial direction is 325 mm. The developing sleeve 24 performs development by carrying magnetic brushes formed from two-component developer including toner and carrier and bringing the magnetic brushes into contact with the photosensitive drum 51 at a developing nip portion. The developing sleeve 24 is connected to a developing bias power source 61 that applies a predetermined developing bias, and the electrostatic image formed on the photosensitive drum 51 is developed with toner as a result of the developing bias applied thereto. In the present exemplary embodiment, the developing bias is an oscillating voltage in which a direct current voltage and an alternate current voltage are superimposed. For example, the developing bias is an oscillating voltage in which an alternate current voltage of a rectangular wave having a frequency of 8.0 kHz and a peak-to-peak voltage of 1.8 kV is superimposed. The direct current voltage is appropriately set such that an appropriate fog-removing potential is achieved with respect to the potential of the photosensitive drum 51 in the developing nip portion.

As illustrated in FIG. 1, the toner image developed on the photosensitive drum 51 is transferred onto an intermediate transfer belt 44*b* of the intermediate transfer unit 44 through primary transfer. The intermediate transfer belt 44*b* serves as a transfer material. The intermediate transfer unit 44 includes a plurality of rollers including a driving roller 44*a*, a driven roller 44*d*, and primary transfer rollers 47*y*, 47*m*, 47*c*, and 47*k*, and the intermediate transfer belt 44*b* that is looped over these rollers and carries a toner image. The primary transfer rollers 47*y*, 47*m*, 47*c*, and 47*k* serving as transfer members are respectively disposed opposite to the photosensitive drums 51*y*, 51*m*, 51*c*, and 51*k*, and abut the intermediate transfer belt 44*b*. The primary transfer rollers 47 are connected to a primary transfer bias power source 62 illustrated in FIG. 3 that applies a primary transfer bias.

The intermediate transfer belt 44*b* comes into contact with the photosensitive drums 51 and forms primary transfer portions between the intermediate transfer belt 44*b* and the photosensitive drums 51, and thus toner images formed on the photosensitive drums 51 are transferred at the primary transfer portions through primary transfer as a result of the primary transfer bias being applied. By applying the primary transfer bias of a positive polarity to the intermediate transfer belt 44*b* via the primary transfer rollers 47, respective toner images having a negative polarity on the photosensitive drums 51 are sequentially transferred onto the intermediate transfer belt 44*b* so as to be superimposed on one another. That is, the primary transfer rollers 47 form primary transfer portions between the primary transfer rollers 47 and the photosensitive drums 51, and toner images formed on the photosensitive drums 51 are transferred onto the intermediate transfer belt 44*b* through primary transfer at the primary transfer portions.

The secondary transfer portion 45 includes a secondary transfer inner roller 45*a* and a secondary transfer outer roller 45*b*. The secondary transfer outer roller 45*b* is connected to a secondary transfer bias power source 63 illustrated in FIG. 3 that applies a secondary transfer bias. By applying a secondary transfer bias of a positive polarity to the secondary transfer outer roller 45*b*, a full-color toner image formed on the intermediate transfer belt 44*b* is transferred onto the sheet S. The secondary transfer outer roller 45*b* abuts the intermediate transfer belt 44*b* and forms a secondary transfer portion 45 between the secondary transfer outer roller 45*b* and the intermediate transfer belt 44*b*, and the toner image transferred onto the intermediate transfer belt 44*b* through primary transfer is transferred onto the sheet S at the secondary transfer portion 45 through secondary transfer by applying the secondary transfer bias.

The fixing portion 46 includes a fixing roller 46*a* and a pressurizing roller 46*b*. As a result of the sheet S being nipped and conveyed between the fixing roller 46*a* and the pressurizing roller 46*b*, the toner image transferred onto the sheet S is heated, pressurized, and thus fixed to the sheet S. The sheet discharge portion feeds the sheet S conveyed through a discharge path after the fixing, and, for example, discharges the sheet S through a discharge port and stacks the sheet S on a discharge tray.

Meanwhile, as illustrated in FIG. 3, the abrasive roller 54 is disposed downstream of the primary transfer roller 47 and upstream of the charging roller 52 in the rotational direction of the photosensitive drum 51. Therefore, the surface of the photosensitive drum 51 after primary transfer is cleaned by the abrasive roller 54. Details of the abrasive roller 54 will be described later.

Transfer residual toner remaining on the surface of the photosensitive drum 51 in a small amount after the cleaning by the abrasive roller 54 is removed from the surface of the photosensitive drum 51 by the cleaning blade 55. The cleaning blade 55 in the present exemplary embodiment employs a counter blade system that is formed from urethane rubber and has a flat-plate shape having a length of 330 mm in the axial direction and a free blade length of 8 mm. The cleaning blade 55 is pressed against the photosensitive drum 51 at a linear pressure of 30 gf/cm. After the toner removal by the cleaning blade 55, electricity is removed from the surface of the photosensitive drum 51 by the electricity removing device 56, and the surface of the photosensitive drum 51 is charged again by the charging roller 52.

The controller 11 is constituted by a computer, and includes, for example, a central processing unit (CPU) 12, a read-only memory (ROM) 13, a random access memory (RAM) 14, and an input/output circuit 15 serving as an interface (I/F). The ROM 13 stores a program for controlling each component, the RAM 14 temporarily stores data, and the input/output circuit 15 inputs and outputs a signal from and to the outside. The CPU 12 is a microprocessor that performs overall control of the image forming apparatus 1, and is a main component of a system controller. The CPU 12 is connected to the sheet feeding portion and the image forming portion 40 via the input/output circuit 15, and thus communicates a signal with each component and controls the operation thereof. The ROM 13 stores an image formation control sequence or the like for forming an image on the sheet S.

The controller 11 is connected to the charging bias power source 60, the developing bias power source 61, the primary transfer bias power source 62, the secondary transfer bias power source 63, and driving motors for various rollers. Here, it is assumed that the linear speed of the photosensitive drum 51 in the abrasive nip portion N, i.e. a rubbing nip portion, is S1 and the linear speed of the abrasive roller 54 in the same direction as the linear speed of the photosensitive drum 51 is S2. In this case, the controller 11 controls the rotational speed of the photosensitive drum 51 and the abrasive roller 54 such that a linear speed ratio S2/S1 satisfies a relationship of S2/S1<1.0. In addition, the controller 11 controls the linear speed ratio S2/S1 so as to satisfy a relationship of −1.0≤S2/S1.

Next, an image forming operation in the image forming apparatus 1 thus configured will be described.

When the image forming operation is started, the photosensitive drum 51 rotates and the surface thereof is charged by the charging roller 52. Then, laser light is emitted from the exposing unit 42, i.e. the exposing device, to the photosensitive drum 51 on the basis of image information, and thus an electrostatic latent image is formed on the surface of the photosensitive drum 51. This electrostatic latent image is developed and visualized as a toner image by toner attaching thereto by the developing unit 20, and the toner image is transferred onto the intermediate transfer belt 44*b*.

Meanwhile, the sheet S is supplied in parallel with such a formation operation of toner image, and the sheet S is conveyed to the secondary transfer portion 45 through a conveyance path at a timing matching conveyance of the toner image on the intermediate transfer belt 44*b*. Further, the toner image is transferred from the intermediate transfer belt 44*b* onto the sheet S, and the sheet S is conveyed to the fixing portion 46. Then, the unfixed toner image is heated and pressurized in the fixing portion 46 to be fixed to the surface of the sheet S, and the sheet S is discharged from the apparatus body 10.

Next, the surface shape of the photosensitive drum 51 in the image forming apparatus 1 of the present exemplary embodiment will be described. As illustrated in FIG. 2, the surface of the photosensitive drum 51 includes a specific recess portion 32*a* and a flat portion 32*b*. In the present exemplary embodiment, the specific recess portion 32*a* has a circular shape as viewed in a depth direction. However, the shape of the specific recess portion 32*a* is not limited to a circular shape, and may be a polygonal shape such as a triangular shape.

Here, definition of the specific recess portion 32*a* and the flat portion 32*b* in a square region of 500 μm×500 μm in the surface of the photosensitive drum 51 will be described below. The specific recess portion 32*a* and the flat portion 32*b* on the surface of the photosensitive drum 51 can be observed by using a microscope such as a laser microscope, an optical microscope, an electron microscope, or an atomic force microscope. First, the surface of the photosensitive drum 51 is observed in a magnified view by a microscope or the like. In the case where the surface of the photosensitive drum 51 in the rotational direction is a curved surface, a sectional profile of the curved surface is extracted, and the sectional profile is fitted by a curved line. The sectional profile is corrected such that the curved line becomes a straight line, and a surface obtained by extending the obtained straight line in the longitudinal direction of the photosensitive drum 51 is set as a standard surface.

Then, a region within ±0.2 μm from the obtained standard surface in terms of height is regarded as the flat portion 32*b* in the square region of 500 μm×500 μm. A portion positioned below the flat portion 32*b* is regarded as a recess portion, and the maximum distance from the flat portion 32*b* to the bottom surface of the recess portion is regarded as the depth of the recess portion. In addition, a section taken along the flat portion 32*b*, that is, a plane having a height level of the flat portion 32*b* is regarded as an opening portion of the recess portion, and the length of the longest line segment among line segments included in the opening portion is regarded as an opening portion maximum diameter D1 of the recess portion. Among recess portions included in the square region of 500 μm×500 μm, recess portions whose depths obtained as described above are within a range of 0.5 μm to 6.0 μm and whose opening portion maximum diameters are within a range of 20 μm to 120 μm will be referred to as specific recess portions 32*a* in the square region of 500 μm×500 μm. That is, the opening portion of each of the specific recess portions 32*a* has a maximum length of 20 μm to 120 μm in the rotational direction.

In a region including the specific recess portions 32*a*, the specific recess portions 32*a* are defined in a predetermined area ratio with respect to the flat portion 32*b* that occupies most part of the surface of the photosensitive drum 51. Due to how the specific recess portions 32*a* are defined, projections 32*c* having a rim shape, which are neither recess portions nor flat portions, are formed around the specific recess portions 32*a*. The specific recess portions 32*a* of the present exemplary embodiment include two kinds of recess portions including a plurality of first recess portions having a depth of 5 μm serving as a first depth and a plurality of second recess portions having a depth of 2 μm serving as a second depth, and these are alternately arranged.

The specific recess portions 32*a* are provided in the surface of the photosensitive drum 51 so as to occupy the following area. The square region of 500 μm×500 μm whose one side is parallel to the rotational direction of the photosensitive drum 51 is disposed in an arbitrary position in the surface of the photosensitive drum 51. In this case, the specific recess portions 32*a* are provided such that the area of the specific recess portions 32*a* in the square region of 500 μm×500 μm is 7500 $\mu m^2$ to 88000 $\mu m^2$. That is, the specific recess portions 32*a* are provided such that the area ratio of the total area of the opening portions of the plurality of specific recess portions 32*a* with respect to the surface area of an image forming region of the photosensitive drum 51 is 3.00% to 3.52%. In addition, the flat portion 32*b* is provided in the surface of the photosensitive drum 51 so as to occupy the following area. The square region of 500 μm×500 μm whose one side is parallel to the rotational direction of the photosensitive drum 51 is disposed in an arbitrary position in the surface of the photosensitive drum 51. In this case, the flat portion 32*b* is provided such that the area of the flat portion 32*b* in the square region of 500 μm×500 μm is 81000 $m^2$ to 240000 $m^2$.

Figure 5A:
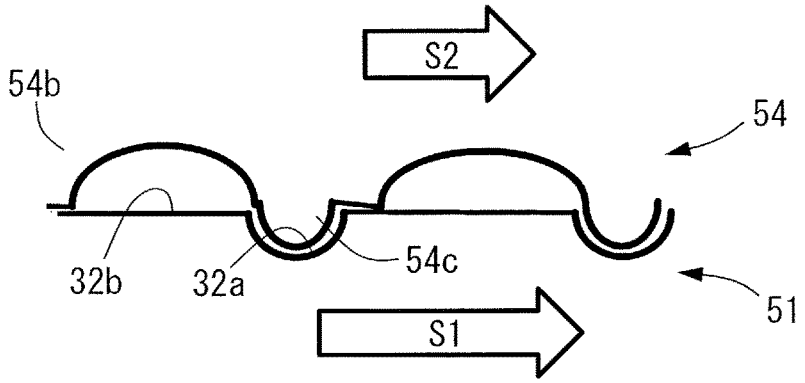
FIG. 5A is an explanatory diagram illustrating projection portions of the abrasive roller and specific recess portions of the photosensitive drum engaging with each other in the case where the linear speed of the photosensitive drum is higher than the linear speed of the abrasive roller in the image forming apparatus according to the exemplary embodiment.

Next, the abrasive roller 54 in the image forming apparatus 1 of the present exemplary embodiment will be described. As illustrated in FIG. 3, in the present exemplary embodiment, the abrasive roller 54 has a length of 330 mm in the axial direction, and is formed by providing, for example, an elastic foam layer 54*b* serving as a surface layer formed from an elastic foam body as an elastic body on the outside of a core metal 54*a* of stainless steel. The elastic foam layer 54*b* is an elastic layer having a foam structure formed from a rubber material or the like. That is, the abrasive roller 54 is constituted by a rotary member including the elastic foam layer 54*b*, abuts the photosensitive drum 51 to form the abrasive nip portion N, i.e. the rubbing nip portion, between the abrasive roller 54 and the photosensitive drum 51, and polishes the photosensitive drum 51 at the abrasive nip portion N by relative rotation. Although the thickness of the elastic foam layer 54*b* is not limited, for example, the overall thickness thereof is about 4 mm to 10 mm. Although physical properties of the elastic foam layer 54*b* are not limited, for example, the average cell diameter thereof is about 100 μm to 1000 μm, the number of air bubble cells thereof is about 10 to 200 per inch, the air permeability thereof is about 0.5 to 10.0 L/min, and the density thereof is about 0.08 to 0.20 g/cm$^3$. To be noted, cells are exposed on the surface of the elastic foam layer 54*b*, and part of these projects as projection portions 54*c* capable of engaging with the specific recess portions 32*a* of the photosensitive drum 51 as illustrated in FIG. 5A. In addition, the elastic body is not limited to an elastic foam body, and may be an elastic body of another material.

When obtaining the average cell diameter of the elastic foam layer 54*b*, a region of about 20 mm$^2$ in the surface of the elastic foam layer 54*b* is observed with an electron microscope or the like, and the maximum length of an opening portion in each cell present in the observed field of view is measured. The average cell diameter can be obtained as an average length obtained by arithmetically averaging the measured maximum length. The average cell diameter of the cells can be adjusted by adjusting the kind and content of a foaming agent contained in a silicone rubber foam composition that forms the elastic foam layer 54*b*, the content of a reaction control agent contained in the silicone rubber foam composition, curing conditions of the silicone rubber foam composition, or the like.

As the rubber material for the elastic foam layer 54*b*, for example, general purpose rubbers such as butadiene rubber, isoprene rubber, chloroprene rubber, and styrene-butadiene rubber, and rubbers such as acrylonitrile, silicone rubber, and polyurethane rubber can be used alone or in combination of two or more kinds. Polyol serving as a raw material for polyurethane rubber is not particularly limited, and polyol to be used can be appropriately selected from various polyols that are conventionally known as raw materials for polyurethane foam. For example, the polyol to be used can be selected from known polyols such as polyether polyol, polyester polyol, and polymer polyol, which are typically used for producing soft polyurethane foams, and these can be used alone or in combination of two or more kinds. To be noted, among the polyols described above, polyether polyol is preferably used for producing a highly-elastic soft polyurethane foam having excellent durability against humidity and heat.

As the polyol, prepolymer that has been polymerized with polyisocyanate in advance may be used. The polyisocyanate is not particularly limited, and polyisocyanate to be used can be appropriately selected from various polyisocyanates that are conventionally known as raw materials for polyurethane foam. For example, the following compounds can be used alone or in combination of two or more kinds: 2,4- and 2,6-tolylene diisocyanate: TDI; tolidine diisocyanate: TODI; naphtylene diisocyanate: NDI; xylylene diisocyanate: XDI; 4,4'-diphenylmethane diisocyanate: MDI; carbodiimide-modified MDI; polymethylene polyphenyl polyisocyanate; and polymeric polyisocyanate. To be noted, as the polyisocyanate, isocyanate-terminated prepolymer obtained by reacting polyisocyanate with one or more kinds of known active hydrogen compounds can be also used.

In addition, the elastic foam layer 54*b* of the abrasive roller 54 preferably has an ASKER FP hardness of 30 to 100. Here, an ASKER FP hardness is a hardness detected by a predetermined durometer, that is, an ASKER rubber durometer FP type manufactured by Kobunshi Keiki Co., Ltd.

Next, an operation of the image forming apparatus 1 of the present exemplary embodiment in the abrasive nip portion N between the abrasive roller 54 and the photosensitive drum 51 will be described. First, as an index of measuring speeds of the abrasive roller 54 and the photosensitive drum 51 at the abrasive nip portion N, observation is performed by using a high-speed video camera, and speed difference between the abrasive roller 54 and the photosensitive drum 51 is exponentialized by using video analysis. A high-speed camera MEMRECAN_GX-8F manufactured by nac Image Technology Inc. is used for the observation. The frame rate of the high-speed camera is 10 KFPS, and the resolution thereof is 640×480 pixels. A semi telephoto lens of 105 mm/f2.8 manufactured by Nikon Corporation is used for the lens. In the observation of behavior of the abrasive roller 54, a cylindrical tube of transparent glass with a transparent conductive film of an indium tin oxide (ITO film) formed thereon is used as the base body 30 of the photosensitive drum 51. In the present exemplary embodiment, the photosensitive drum 51 is formed by applying three layers of an undercoat layer, the charge generation layer 31, and the charge transport layer 32 on the base body 30 in this order from the bottom to the top. When calculating the speeds of the abrasive roller 54 and the photosensitive drum 51, video analysis software, that is, motion analysis software TEMA available from Photron Limited, is used.

Figure 4A:
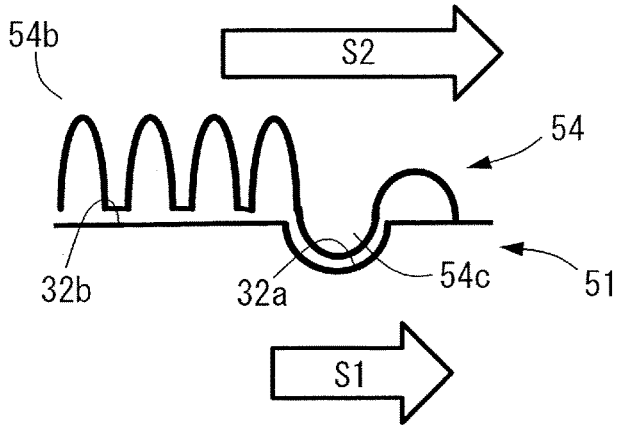
FIG. 4A is an explanatory diagram illustrating a projection portion of an abrasive roller and a specific recess portion of a photosensitive drum engaging with each other in the case where the linear speed of the abrasive roller is faster than the linear speed of the photosensitive drum in an image forming apparatus of a comparative example.
Figure 4B:
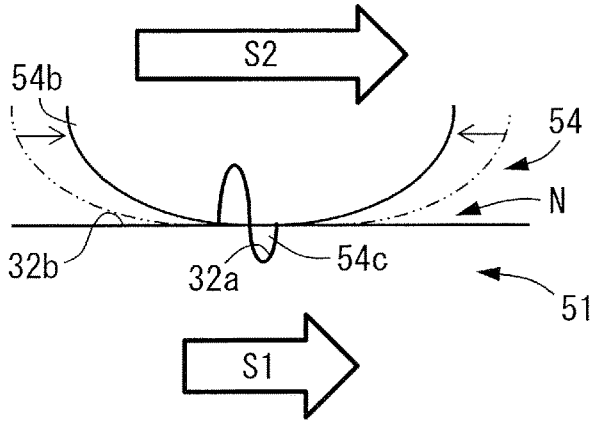
FIG. 4B is an explanatory diagram illustrating the entirety of an abrasive nip portion in the case where the linear speed of the abrasive roller is higher than the linear speed of the photosensitive drum in the image forming apparatus of the comparative example.

Hereinafter, it is assumed that the linear speed of the photosensitive drum 51 is S1 and the linear speed of the abrasive roller 54 is S2. First, a case where the abrasive roller 54 is rotated quickly in a direction following the photosensitive drum 51 as illustrated in FIGS. 4A and 4B, that is, a case where 1<S2/S1 holds will be described. In this case, when the abrasive roller 54 enters the abrasive nip portion N, part of the projection portions 54*c* of the cells of the abrasive roller 54 engage with the specific recess portions 32*a* when abutting the photosensitive drum 51. The elastic foam layer 54*b* is squashed in the peripheral direction as a result of this engagement and friction at the abrasive nip portion N, and thus the abrasive roller 54 rotates in accordance with the photosensitive drum 51 at a speed lower than the linear speed S2 that is the aimed linear speed. Therefore, on the upstream side of the photosensitive drum 51 at the abrasive nip portion N in the rotational direction, the speed difference becomes smaller, and the abrasive roller 54 becomes less likely to rub the surface of the photosensitive drum 51. To be noted, in the case where S1=S2 holds, that is, where S2/S1=1 holds, there is no speed difference between the photosensitive drum 51 and the abrasive roller 54, and thus the abrasive roller 54 becomes less likely to rub the surface of the photosensitive drum 51.

Figure 4C:
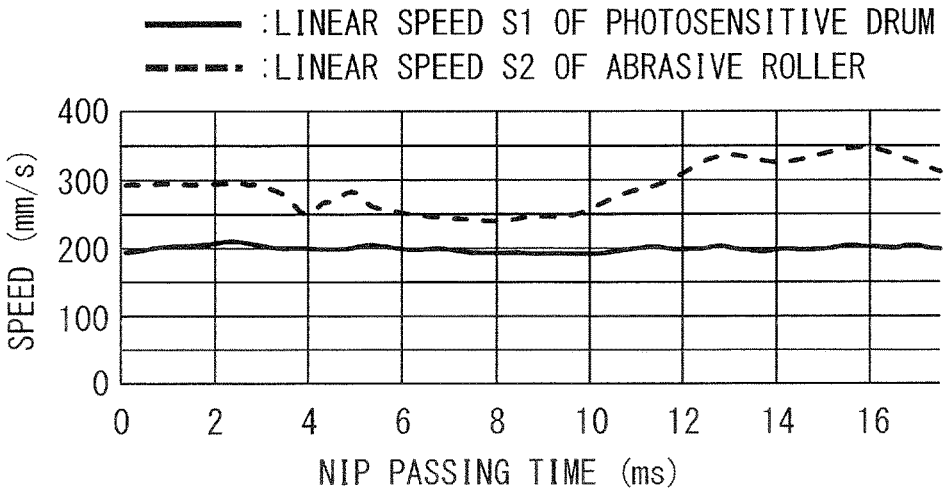
FIG. 4C is an explanatory diagram illustrating measurement results of respective linear speeds in the case where the linear speed of the abrasive roller is higher than the linear speed of the photosensitive drum in the image forming apparatus of the comparative example.

The linear speed S1 of the photosensitive drum 51 and the linear speed S2 of the abrasive roller 54 when passing through the abrasive nip portion N have a relationship illustrated in FIG. 4C. As illustrated in FIG. 4C, although the linear speed S1 of the photosensitive drum 51 is stable, the linear speed S2 of the abrasive roller 54 unstably following the photosensitive drum 51 is unstable, thus the abrasive nip portion N becomes smaller, and it is expected that the capability of removing the electric discharge products is degraded.

Figure 5B:
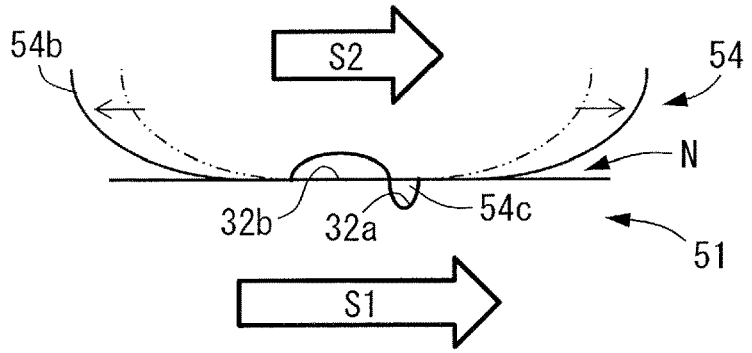
FIG. 5B is an explanatory diagram illustrating the entirety of an abrasive nip portion in the case where the linear speed of the photosensitive drum is higher than the linear speed of the abrasive roller in the image forming apparatus according to the exemplary embodiment.

Next, a case where the abrasive roller 54 is rotated slowly in the direction following the photosensitive drum 51 as illustrated in FIGS. 5A and 5B, that is, a case where 0<S2/S1<1 holds, will be described. In this case, when the abrasive roller 54 enters the abrasive nip portion N, part of the projection portions 54*c* of the cells of the abrasive roller 54 engage with the specific recess portions 32*a* when abutting the photosensitive drum 51. As a result of this engagement and friction at the abrasive nip portion N, the elastic foam layer 54*b* is pulled downstream in the peripheral direction, and thus the abrasive roller 54 rotates in accordance with the photosensitive drum 51 at a speed higher than the linear speed S2 that is the aimed linear speed. Therefore, the speed difference is maintained constant in the entirety of the abrasive nip portion N, and the abrasive roller 54 is likely to rub the surface of the photosensitive drum 51. To be noted, the same behavior is exhibited in the case where the abrasive roller 54 is stopped, that is, where S2/S1=0 holds.

Figure 5C:
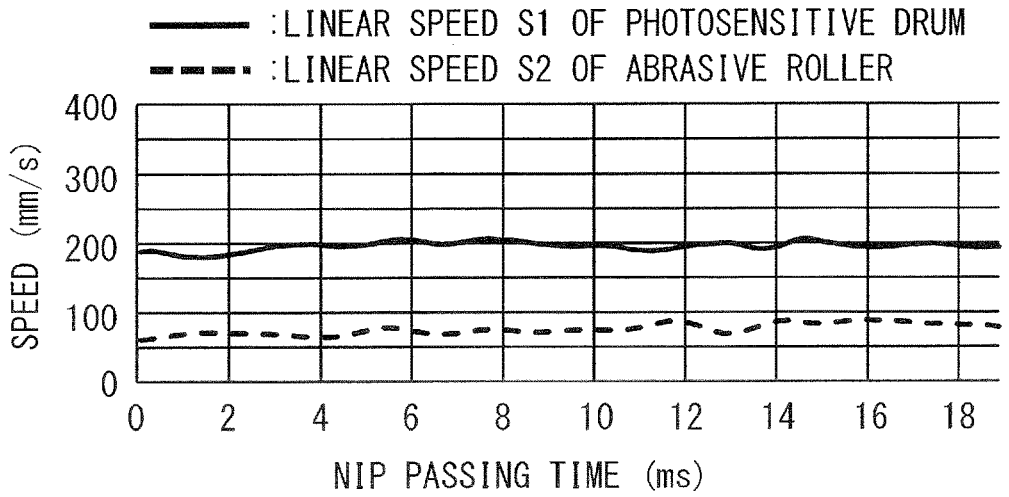
FIG. 5C is an explanatory diagram illustrating measurement results of respective linear speeds in the case where the linear speed of the photosensitive drum is higher than the linear speed of the abrasive roller in the image forming apparatus according to the exemplary embodiment.

The linear speed S1 of the photosensitive drum 51 and the linear speed S2 of the abrasive roller 54 when passing through the abrasive nip portion N have a relationship illustrated in FIG. 5C. As illustrated in FIG. 5C, similarly to the linear speed S1 of the photosensitive drum 51 that is stable, the linear speed S2 of the abrasive roller 54 is also stable, the abrasive nip portion N becomes larger, and thus it is expected that the capability of removing the electric discharge products improves.

Figure 6A:
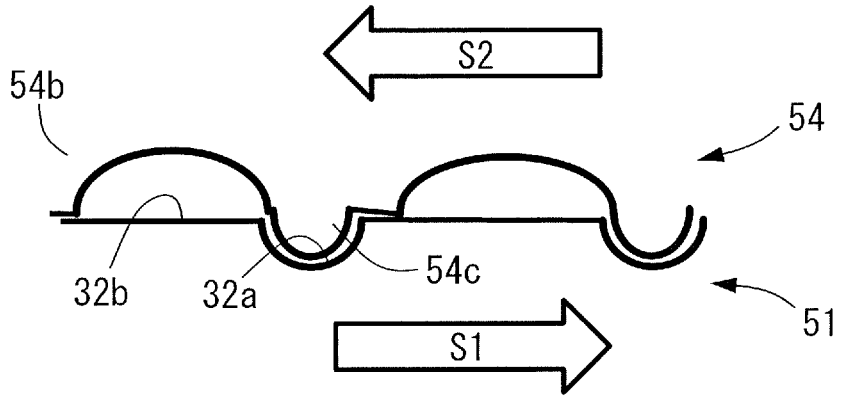
FIG. 6A is an explanatory diagram illustrating projection portions of the abrasive roller and specific recess portions of the photosensitive drum engaging with each other in the case where the linear speed of the abrasive roller is in the opposite direction to the linear speed of the photosensitive drum in an abrasive nip portion of the image forming apparatus according to the exemplary embodiment.
Figure 6B:
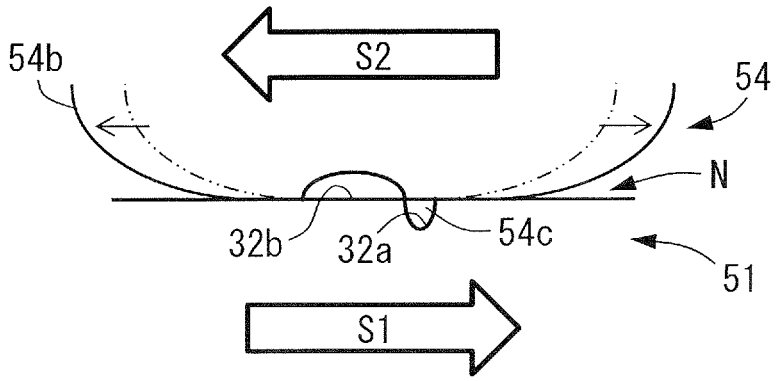
FIG. 6B is an explanatory diagram illustrating the entirety of the abrasive nip portion in the case where the linear speed of the abrasive roller is in the opposite direction to the linear speed of the photosensitive drum in an abrasive nip portion of the image forming apparatus according to the exemplary embodiment.

In addition, a case where the abrasive roller 54 is rotated in an opposite direction with respect to the photosensitive drum 51 as illustrated in FIGS. 6A and 6B, that is, a case where S2/S1<0 holds will be described. Here, since S1 and S2 are opposite in a positive/negative relationship, the linear speed S2 of the abrasive roller 54 and the linear speed S1 of the photosensitive drum 51 have a relationship of S1>S2. Also in this case, when the abrasive roller 54 enters the abrasive nip portion N, part of the projection portions 54*c* of the cells of the abrasive roller 54 engage with the specific recess portions 32*a* when abutting the photosensitive drum 51. As a result of this engagement and friction at the abrasive nip portion N, the elastic foam layer 54*b* is pulled downstream in the peripheral direction, and thus the abrasive roller 54 rotates in accordance with the photosensitive drum 51 at a speed higher than the linear speed S2 that is the aimed linear speed. Therefore, the speed difference is maintained constant in the entirety of the abrasive nip portion N, and the abrasive roller 54 is likely to rub the surface of the photosensitive drum 51.

Figure 7A:
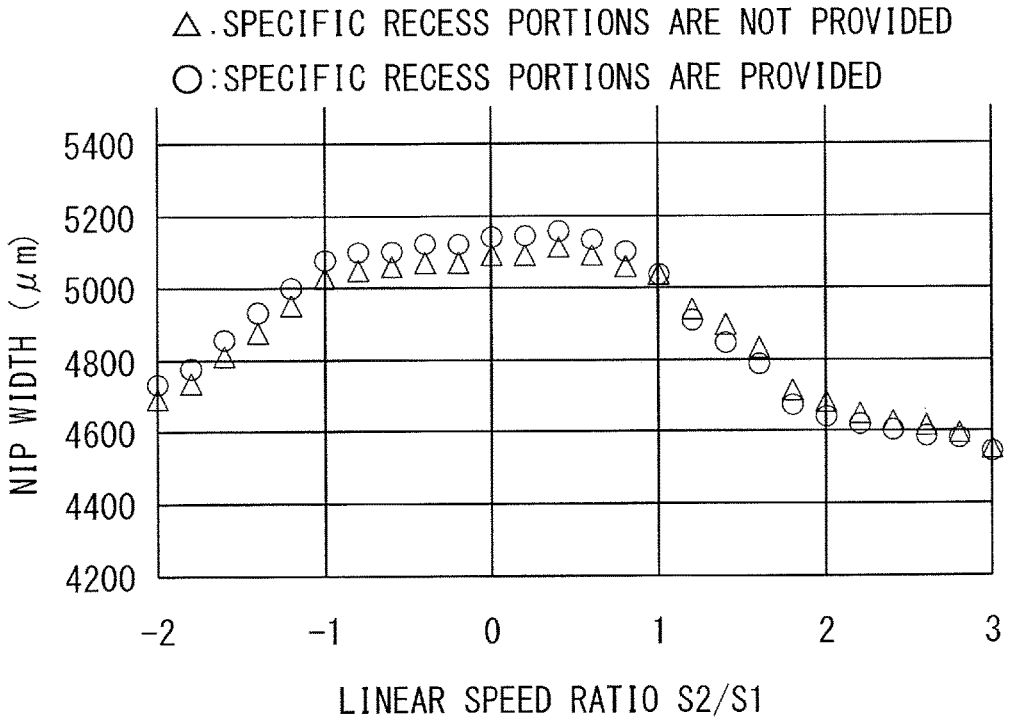
FIG. 7A is an explanatory diagram illustrating a relationship between a linear speed ratio and a nip width in accordance with the presence/absence of specific recess portions of the photosensitive drum in an abrasive nip portion of an image forming apparatus.

When measuring the nip width in the abrasive nip portion N, the nip width is exponentialized by measuring the width in which the abrasive roller 54 is in contact with the photosensitive drum 51 based on an image captured by a high-speed camera. FIG. 7A illustrates a relationship between the linear speed S2/S1 and the nip width obtained in this manner together with presence/absence of the specific recess portions 32*a*. As illustrated in FIG. 7A, in the case where the abrasive roller 54 is rotated quickly in the direction following the photosensitive drum 51, that is, where 1<S2/S1 holds, cells of the abrasive roller 54 are caught in the specific recess portions 32*a* of the photosensitive drum 51 when the photosensitive drum 51 includes the specific recess portions 32*a*. In addition, since the cells of the abrasive roller 54 are squashed due to friction as a result of the linear speed S2 of the abrasive roller 54 being higher than the linear speed S1 of the photosensitive drum 51, the nip width is narrower than in the case of a photosensitive drum not including the specific recess portions 32*a*.

In addition, in the case where the abrasive roller 54 is rotated slowly or in an opposite direction with respect to the photosensitive drum 51, that is, where S2/S1<1 holds, the cells of the abrasive roller 54 are caught in the specific recess portions 32*a* of the photosensitive drum 51 when the photosensitive drum 51 includes the specific recess portions 32*a*. In addition to this, since the cells of the abrasive roller 54 are pulled downstream due to friction as a result of the linear speed S1 of the photosensitive drum 51 being higher than the linear speed S2 of the abrasive roller 54, the nip width is wider than in the case of a photosensitive drum not including the specific recess portions 32*a*. Particularly, the nip width is wider in a range where −1<S2/S1<1 holds.

Figure 7B:
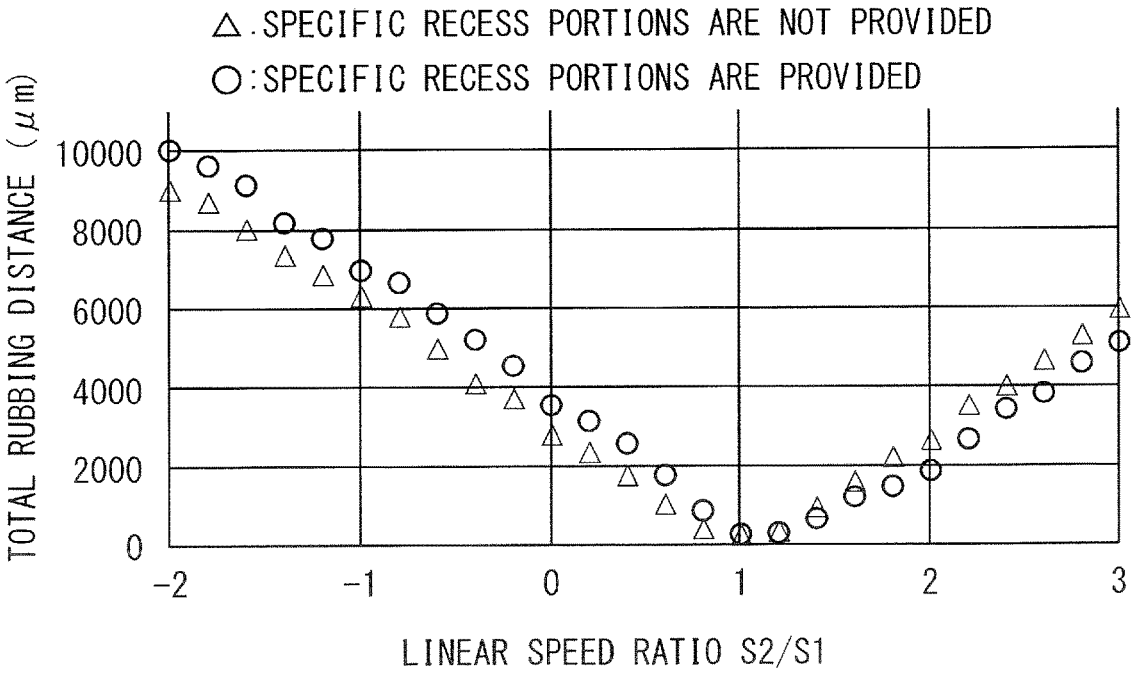
FIG. 7B is an explanatory diagram illustrating a relationship between a linear speed ratio and a total rubbing distance in accordance with the presence/absence of the specific recess portions of the photosensitive drum in an abrasive nip portion of an image forming apparatus.

Further, a relationship between the linear speed ratio S2/S1 and polishing performance is obtained on the basis of the speed difference between the abrasive roller 54 and the photosensitive drum 51, the nip width, and further the presence/absence of the specific recess portions 32*a* of the photosensitive drum 51, and results thereof are shown in FIG. 7B. The polishing performance is defined as total rubbing distance. As illustrated in FIG. 7B, it is confirmed that the capability of removing the electric discharge products can be improved in the case where the abrasive roller 54 is rotated slowly or in an opposite direction with respect to the photosensitive drum 51, that is, where S2/S1<1 holds.

In the present exemplary embodiment, since the photosensitive drum 51 including the specific recess portions 32*a* on the surface thereof is used and the abrasive roller 54 is rotated in the opposite direction or slowly in the direction following the photosensitive drum 51, the effect of suppressing the image deletion can be improved. In addition, in the case where the abrasive roller 54 is rotated in the opposite direction or slowly in the direction following the photosensitive drum 51, the nip width increases, the speed difference between the abrasive roller 54 and the photosensitive drum 51 is maintained constant, and thus the polishing performance is improved when the photosensitive drum 51 includes the specific recess portions 32*a* on the surface thereof. However, in the case where the abrasive roller 54 is rotated quickly in the direction following the photosensitive drum 51, the nip width decreases, the speed difference between the photosensitive drum 51 and the abrasive roller 54 decreases, and thus the polishing performance is degraded. To effectively suppress the image deletion, it is preferable that the linear speed ratio S2/S1 is smaller than 1.0, and it is more preferable that the linear speed ratio S2/S1 is equal to or larger than −1.0 and smaller than 1.0.

As described above, according to the image forming apparatus 1 of the present exemplary embodiment, the linear speed ratio S2/S1 of the linear speed S2 of the abrasive roller 54 and the linear speed S1 of the photosensitive drum 51 is set to a value smaller than 1.0. Therefore, the linear speed S2 of the abrasive roller 54 is in the opposite direction to the liner speed S1 of the photosensitive drum 51 or low in the same direction as the linear speed S1. Therefore, the capability of removing the electric discharge products by the abrasive roller 54 being degraded as in the case where the abrasive roller 54 is rotated in the direction following the rotational direction of the photosensitive drum 51 including the specific recess portions 32*a* at a linear speed higher than that of the photosensitive drum 51 can be suppressed. Hence, the capability of removing the electric discharge products by the abrasive roller 54 being degraded while using the photosensitive drum 51 including the specific recess portions 32*a* on the surface thereof can be suppressed. In addition, according to the image forming apparatus 1 of the present exemplary embodiment, since the linear speed ratio S2/S1 is set to −1.0 or larger, the capability of removing the electric discharge products by the abrasive roller 54 can be improved more.

In addition, according to the image forming apparatus 1 of the present exemplary embodiment, since the opening portion maximum diameter of the specific recess portions 32*a* is set to 20 μm to 120 μm, the capability of removing the electric discharge products by the abrasive roller 54 being degraded can be effectively suppressed. To be noted, by setting the opening portion maximum diameter of the specific recess portions 32*a* to 20 μm to 100 μm, the capability of removing the electric discharge products by the abrasive roller 54 being degraded can be further effectively suppressed.

In addition, according to the image forming apparatus 1 of the present exemplary embodiment, since the ASKER FP hardness of the elastic foam layer 54*b* is set to 30 to 100, the capability of removing the electric discharge products by the abrasive roller 54 being degraded can be more effectively suppressed. To be noted, by setting the ASKER FP hardness of the elastic foam layer 54*b* to 40 to 90, the capability of removing the electric discharge products by the abrasive roller 54 being degraded can be further effectively suppressed.

EXAMPLES

Printing was performed on 1000 sheets by using the image forming apparatus 1 of the present exemplary embodiment described above in an environment of a room temperature of 30° C. and a humidity of 80%, and then the image forming apparatus 1 was left to stand for 12 hours in the same environment. Thereafter, image formation was performed, and occurrence conditions of image deletion were evaluated. Here, evaluation was performed while changing the ASKER FP hardness of the elastic foam layer 54*b* and the opening portion maximum diameter of the specific recess portions 32*a* for each linear speed ratio S2/S1 of the abrasive roller 54. To be noted, the linear speed ratio S2/S1 was set to be smaller than 1.0. The results thereof are shown in Tables 1 to 5. Each table corresponds to a different value of linear speed ratio.

TABLE 1

| Linear speed | | Opening portion maximum diameter (μm) of specific recess portions | | | | | | |
|---|---|---|---|---|---|---|---|---|
| Ratio: −2.0 | | 10 | 20 | 40 | 70 | 100 | 120 | 130 |
| FP hardness | 20 | Image deletion Sponge abrasion | Image deletion | Image deletion | Image deletion | Image deletion | Image deletion | Drum scratches |
| | 30 | Image deletion Sponge abraison | Good *1 | Good *1 | Good *1 | Good *1 | Good *1 | Drum scratches |
| | 40 | Image deletion Sponge abraison | Good *1 | Good *1 | Good *1 | Good *1 | Good *2 | Drum scratches |
| | 60 | Image deletion Sponge abraison | Good *1 | Good *1 | Good *1 | Good *1 | Good *2 | Drum scratches |
| | 90 | Image deletion Sponge abraison | Good *1 | Good *1 | Good *1 | Good *1 | Good *2 | Drum scratches |
| | 100 | Image deletion Sponge abraison | Good *2 | Good *2 | Good *2 | Good *2 | Good *2 | Drum scratches |
| | 110 | Drum scratches | Drum scratches | Drum scratches | Drum scratches | Drum scratches | Drum scratches | Drum scratches |

*1: There was no problem on images, but slight sponge abrasion occurred.

*2: There was no problem on images, but slight drum scratches were recognized.

TABLE 2

| Linear speed | | Opening portion maximum diameter (μm) of specific recess portions | | | | | | |
|---|---|---|---|---|---|---|---|---|
| Ratio: −1.6 | | 10 | 20 | 40 | 70 | 100 | 120 | 130 |
| FP hardness | 20 | Image deletion Sponge abrasion | Image deletion | Image deletion | Image deletion | Image deletion | Image deletion | Drum scratches |
| | 30 | Image deletion Sponge abraison | Good *1 | Good *1 | Good *1 | Good *1 | Good *1 | Drum scratches |
| | 40 | Image deletion Sponge abraison | Good *1 | Good *1 | Good *1 | Good *1 | Good *2 | Drum scratches |
| | 60 | Image deletion Sponge abraison | Good *1 | Good *1 | Good *1 | Good *1 | Good *2 | Drum scratches |
| | 90 | Image deletion Sponge abraison | Good *1 | Good *1 | Good *1 | Good *1 | Good *2 | Drum scratches |
| | 100 | Image deletion Sponge abraison | Good *2 | Good *2 | Good *2 | Good *2 | Good *2 | Drum scratches |
| | 110 | Drum scratches | Drum scratches | Drum scratches | Drum scratches | Drum scratches | Drum scratches | Drum scratches |

*1: There was no problem on images, but slight sponge abrasion occurred.

*2: There was no problem on images, but slight drum scratches were recognized.

TABLE 3

| Linear speed | | Opening portion maximum diameter (μm) of specific recess portions | | | | | | |
|---|---|---|---|---|---|---|---|---|
| Ratio: −1.0 | | 10 | 20 | 40 | 70 | 100 | 120 | 130 |
| FP hardness | 20 | Image deletion Sponge abrasion | Image deletion | Image deletion | Image deletion | Image deletion | Image deletion | Drum scratches |
| | 30 | Image deletion Sponge abraison | Good *1 | Good *1 | Good *1 | Good *1 | Good *1 | Drum scratches |

TABLE 3-continued

| Linear speed | Opening portion maximum diameter (μm) of specific recess portions | | | | | | |
|---|---|---|---|---|---|---|---|
| Ratio: −1.0 | 10 | 20 | 40 | 70 | 100 | 120 | 130 |
| 40 | Image deletion Sponge abraison | Great | Great | Great | Great | Good *2 | Drum scratches |
| 60 | Image deletion Sponge abraison | Great | Great | Great | Great | Good *2 | Drum scratches |
| 90 | Image deletion Sponge abraison | Great | Great | Great | Great | Good *2 | Drum scratches |
| 100 | Image deletion Sponge abraison | Good *2 | Good *2 | Good *2 | Good *2 | Good *2 | Drum scratches |
| 110 | Drum scratches | Drum scratches | Drum scratches | Drum scratches | Drum scratches | Drum scratches | Drum scratches |

*1: There was no problem on images, but slight sponge abrasion occurred.
*2: There was no problem on images, but slight drum scratches were recognized.

TABLE 4

| Linear speed | Opening portion maximum diameter (μm) of specific recess portions | | | | | | |
|---|---|---|---|---|---|---|---|
| Ratio: −0.4 | 10 | 20 | 40 | 70 | 100 | 120 | 130 |
| FP hardness 20 | Image deletion Sponge abrasion | Image deletion | Image deletion | Image deletion | Image deletion | Image deletion | Drum scratches |
| 30 | Image deletion Sponge abraison | Good *1 | Good *1 | Good *1 | Good *1 | Good *1 | Drum scratches |
| 40 | Image deletion Sponge abraison | Great | Great | Great | Great | Good *2 | Drum scratches |
| 60 | Image deletion Sponge abraison | Great | Great | Great | Great | Good *2 | Drum scratches |
| 90 | Image deletion Sponge abraison | Great | Great | Great | Great | Good *2 | Drum scratches |
| 100 | Image deletion Sponge abraison | Good *2 | Good *2 | Good *2 | Good *2 | Good *2 | Drum scratches |
| 110 | Drum scratches | Drum scratches | Drum scratches | Drum scratches | Drum scratches | Drum scratches | Drum scratches |

*1: There was no problem on images, but slight sponge abrasion occurred.
*2: There was no problem on images, but slight drum scratches were recognized.

TABLE 5

| Linear speed | Opening portion maximum diameter (μm) of specific recess portions | | | | | | |
|---|---|---|---|---|---|---|---|
| Ratio: 0.4 | 10 | 20 | 40 | 70 | 100 | 120 | 130 |
| FP hardness 20 | Image deletion Sponge abrasion | Image deletion | Image deletion | Image deletion | Image deletion | Image deletion | Drum scratches |
| 30 | Image deletion Sponge abraison | Good *1 | Good *1 | Good *1 | Good *1 | Good *1 | Drum scratches |
| 40 | Image deletion Sponge abraison | Great | Great | Great | Great | Good *2 | Drum scratches |
| 60 | Image deletion Sponge abraison | Great | Great | Great | Great | Good *2 | Drum scratches |
| 90 | Image deletion Sponge abraison | Great | Great | Great | Great | Good *2 | Drum scratches |
| 100 | Image deletion Sponge abraison | Good *2 | Good *2 | Good *2 | Good *2 | Good *2 | Drum scratches |
| 110 | Drum scratches | Drum scratches | Drum scratches | Drum scratches | Drum scratches | Drum scratches | Drum scratches |

*1: There was no problem on images, but slight sponge abrasion occurred.
*2: There was no problem on images, but slight drum scratches were recognized.

In the examples described above, as shown in Tables 1 to 5, image deletion occurred when the ASKER FP hardness was 20. This is considered to be because tear strength generally also decreases when hardness decreases, and the polishing force decreased as a result of occurrence of wear of the surface layer of the abrasive roller 54. Further, when the ASKER FP hardness was 110, drum scratches were generated regardless of the linear speed ratio and the opening portion maximum diameter of the specific recess portions 32*a*. This is considered to be because the hardness of the abrasive roller 54 was high and the surface layer of the photosensitive drum 51 was abraded.

When the opening portion maximum diameter of the specific recess portions 32*a* was 10 μm and the ASKER FP hardness was 20 to 100, image deletion and abrasion of the surface layer of the sponge both occurred. This is considered to be because the diameter of the specific recess portions 32*a* was small, thus the torque of the drum increased, and wear of the abrasive roller 54 was promoted more. In addition, when the opening portion maximum diameter of the specific recess portions 32*a* was 130 μm, drum scratches were generated. This is considered to be because the specific recess portions 32*a* were wide, thus contact pressure between the surface layer of the photosensitive drum 51 and the cleaning blade 55 increased, and therefore wear of the surface layer of the photosensitive drum 51 was promoted to generate scratches.

Therefore, in the examples described above, good results were obtained when the opening portion maximum diameter of the specific recess portions 32*a* was in the range of 20 μm to 120 μm and the ASKER FP hardness of the elastic foam layer 54*b* was in the range of 30 to 100. That is, the electric discharge products on the surface of the photosensitive drum 51 were successfully removed, and a good image free from charging failure caused by image deletion was obtained. Particularly, more effective results were obtained when the opening portion maximum diameter of the specific recess portions 32*a* was in the range of 20 μm to 100 μm and the ASKER FP hardness of the elastic foam layer 54*b* was in the range of 40 to 90.

Comparative Examples

In contrast with the examples described above, occurrence conditions of image deletion were evaluated while setting the linear speed ratio S2/S1 to 1.0 or larger and using the same values for the other conditions. The results thereof are shown in Tables 6 and 7. Tables 6 and 7 correspond to different linear speed ratios.

TABLE 6

| Linear speed | | Opening portion maximum diameter (μm) of specific recess portions | | | | | | |
|---|---|---|---|---|---|---|---|---|
| Ratio: 1.0 | | 10 | 20 | 40 | 70 | 100 | 120 | 130 |
| FP hardness | 20 | | | Image deletion | | | | |
| | 30 | | | Image deletion | | | | |
| | 40 | | | Image deletion | | | | |
| | 60 | | | Image deletion | | | | |
| | 90 | | | Image deletion | | | | |
| | 100 | | | Image deletion | | | | |
| | 110 | | | Image deletion | | | | |

TABLE 7

| Linear speed | | Opening portion maximum diameter (μm) of specific recess portions | | | | | | |
|---|---|---|---|---|---|---|---|---|
| Ratio: 1.6 | | 10 | 20 | 40 | 70 | 100 | 120 | 130 |
| FP hardness | 20 | | | Image deletion<br>Sponge abrasion | | | | |
| | 30 | | | Image deletion<br>Toner scattering | | | | |
| | 40 | | | Image deletion<br>Toner scattering | | | | |
| | 60 | | | Image deletion<br>Toner scattering | | | | |
| | 90 | | | Image deletion<br>Toner scattering | | | | |
| | 100 | | | Image deletion<br>Toner scattering | | | | |
| | 110 | | | Image deletion<br>Drum scratches | | | | |

In the comparative examples described above, as shown in Table 6, in the case where the linear speed ratio was 1.0, image deletion occurred regardless of the ASKER FP hardness and the opening portion maximum diameter of the specific recess portions 32*a* independently provided on the surface of the photosensitive drum 51. This is considered to be because the abrasive roller 54 and the photosensitive drum 51 rotated at the same speed and the surface of the photosensitive drum 51 was not rubbed.

As shown in Table 7, in the case where the linear speed ratio exceeded 1.0, sponge abrasion occurred when the ASKER FP hardness was 20. This is considered to be because tear strength generally also decreases when hardness decreases, and thus the polishing force decreased as a result of occurrence of wear of the surface layer of the abrasive roller 54. Similarly, in the case where the linear speed ratio exceeded 1.0, toner scattering occurred when the ASKER FP hardness was 30 to 100. This is considered to be because the linear speed of the abrasive roller 54 was high, thus toner on the photosensitive drum 51 was blown off to be scattered, and thus an image of a good quality was not obtained. Similarly, in the case where the linear speed ratio exceeded 1.0, drum scratches were generated when the ASKER FP hardness was 110. This is considered to be because the hardness of the abrasive roller 54 was high, and thus the surface layer of the photosensitive drum 51 was abraded.

As described above, it was confirmed that it is difficult to output an image of a good quality in the case where the linear speed ratio S2/S1 of the abrasive roller 54 is 1.0 or larger.

To be noted, although a case where the specific recess portions 32*a* of the image forming apparatus 1 of the exemplary embodiment described above are a plurality of independent recess portions has been described, the configuration is not limited to this. For example, the recess portions may have long groove shapes extending along the axial direction of the photosensitive drum 51, and also in this case, by setting the maximum length of the opening portion in the rotational direction to, for example, 20 μm to 120 μm, an effect equivalent to the case of employing the specific recess portions 32*a* can be obtained.

In addition, although a case where an image forming apparatus of an intermediate transfer system that forms an image on a recording material by secondary transfer from the intermediate transfer belt 44*b* is used as the image forming apparatus 1 of the exemplary embodiment described above has been described, the configuration is not limited to this. For example, the present invention may be applied to an image forming apparatus of a system that directly transfers a toner image from a photosensitive drum onto the recording material.

According to the present invention, the maximum length in the rotational direction of an opening portion of the recess portion is set to 20 μm to 120 μm and the linear speed ratio S2/S1 of the linear speed S2 of the rubbing member and the linear speed S1 of the image bearing member is set to a value smaller than 1.0. Therefore, the linear speed S2 of the rubbing member is in the opposite direction to the liner speed S1 of the image bearing member or low in the same direction as the linear speed S1. Therefore, the capability of removing the electric discharge products by the rubbing member being degraded as in the case where the rubbing member is rotated in the direction following the rotational direction of the image bearing member including the recess portions at a linear speed higher than that of the image bearing member can be suppressed. Hence, the capability of removing the electric discharge products by the rubbing member being degraded while using the image bearing member including the recess portions on the surface thereof can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

The present invention can be applied to image forming apparatuses such as copiers and laser beam printers that employ an electrophotographic system or an electrostatic recording system, and is particularly preferably used for an image forming apparatus that includes a photosensitive drum including recess portions on the surface thereof.

What is claimed is:

1. An image forming apparatus comprising:

an image bearing member comprising a plurality of recess portions on a surface thereof and configured to rotate;

a charging member configured to charge the image bearing member;

an exposing device configured to expose the image bearing member charged by the charging member to form an electrostatic image;

a developing device configured to develop the electrostatic image formed on the image bearing member with toner;

a transfer member configured to form a transfer portion between the transfer member and the image bearing member and configured to transfer a toner image formed on the image bearing member onto a transfer material at the transfer portion; and a rotatable rubbing member disposed downstream of the transfer portion and upstream of the charging member with respect to a rotational direction of the image bearing member, the rubbing member including a surface layer formed from an elastic body, and configured to come into contact with the image bearing member to form a rubbing nip portion between the rubbing member and the image bearing member, wherein the surface layer has an ASKER FP hardness of 40 to 90, wherein the recess portions each has an opening portion whose maximum length in the rotational direction is 20 μm to 120 μm, and wherein, in a case in which a linear speed of the image bearing member at the rubbing nip portion is S1 and a linear speed of the rubbing member in the same direction as the linear speed of the image bearing member at the rubbing nip portion is S2, a relationship of a linear speed ratio of $S2/S1<1.0$ is satisfied.

2. The image forming apparatus according to claim 1, wherein the linear speed ratio satisfies a relationship of $-1.0 \leq S2/S1$.

3. The image forming apparatus according to claim 1, wherein the recess portions each has a depth of 0.5 μm to 6.0 μm.

4. The image forming apparatus according to claim 1, wherein, in each of the recess portions, the maximum length of the opening portion in the rotational direction is equal to or less than 100 μm.

5. The image forming apparatus according to claim 1, wherein an area ratio of a total area of opening portions of the plurality of recess portions to a surface area of an image forming region of the image bearing member is 3.00% to 3.52%.

6. The image forming apparatus according to claim 1, wherein the plurality of recess portions each has an independent circular shape.

7. The image forming apparatus according to claim 1, wherein the surface layer is formed from an elastic foam body.

* * * * *